US010989217B2

(12) United States Patent
Horng et al.

(10) Patent No.: US 10,989,217 B2
(45) Date of Patent: Apr. 27, 2021

(54) BLADE ADAPTER AND CEILING FAN INCLUDING THE SAME

(71) Applicant: Sunonwealth Electric Machine Industry Co., Ltd., Kaohsiung (TW)

(72) Inventors: Alex Horng, Kaohsiung (TW); Kun-Ta Yang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 189 days.

(21) Appl. No.: 16/255,951

(22) Filed: Jan. 24, 2019

(65) Prior Publication Data

US 2019/0390684 A1 Dec. 26, 2019

(30) Foreign Application Priority Data

Jun. 22, 2018 (TW) ..... 107121560

(51) Int. Cl.
*F04D 25/08* (2006.01)
*F04D 29/26* (2006.01)
*F04D 19/00* (2006.01)

(52) U.S. Cl.
CPC ..... *F04D 29/263* (2013.01); *F04D 25/088* (2013.01); *F04D 19/002* (2013.01)

(58) Field of Classification Search
CPC ..... F04D 29/263; F04D 25/088; F04D 19/002
See application file for complete search history.

(56) References Cited

U.S. PATENT DOCUMENTS 3,735,471 A * 5/1973 Kappler ..... F04D 29/263 29/261
3,825,369 A * 7/1974 Albertzart ..... F04D 29/388 416/229 R
3,912,375 A * 10/1975 Franklin, Sr. ..... F04D 29/263 416/244 R
4,053,259 A * 10/1977 Bianchi ..... F04D 29/36 416/208
4,538,973 A 9/1985 Angott et al.
(Continued)

FOREIGN PATENT DOCUMENTS

CN 202073834 U 12/2011
GB 1004559 A 9/1965
(Continued)

*Primary Examiner* — Christopher Verdier
*Assistant Examiner* — Theodore C Ribadeneyra
(74) *Attorney, Agent, or Firm* — Alan D. Kamrath; Karin L. Williams; Mayer & Williams PC

(57) ABSTRACT

A blade adapter includes a support portion and a plurality of blade connection sections. The plurality of blade connection sections is connected to an outer periphery of the support portion. Each of the plurality of blade connection sections has a first face and a blade connection face opposite to the first face. The blade connection face includes at least one inclined portion. A windward adjustment angle or an inclination adjustment angle is presented between the at least one inclined portion and a horizontal plane. In addition, a ceiling fan includes a motor, the blade adapter, and a plurality of blades. The support portion of the blade adapter is coupled with the motor. The plurality of blades is coupled with the blade connection faces of the plurality of blade connection sections, respectively.

14 Claims, 10 Drawing Sheets

(56) References Cited

U.S. PATENT DOCUMENTS

| | | | | | |
|---|---|---|---|---|---|
| 4,776,761 | A * | 10/1988 | Diaz | F04D 29/366 | 416/142 |
| 5,222,864 | A * | 6/1993 | Pearce | F04D 25/088 | 248/344 |
| 5,899,663 | A | 5/1999 | Feder et al. | | |
| 5,980,353 | A * | 11/1999 | Wu | F04D 25/088 | 403/294 |
| 6,699,014 | B1 * | 3/2004 | Lam | F04D 25/088 | 416/210 R |
| 6,715,989 | B2 | 4/2004 | Mosiewicz et al. | | |
| 10,502,236 | B2 * | 12/2019 | Mosiewicz | F04D 29/382 | |
| 2003/0219340 | A1 * | 11/2003 | Hidalgo | F04D 29/34 | 416/206 |
| 2003/0228224 | A1 * | 12/2003 | Lee | F04D 25/088 | 416/210 R |
| 2004/0037702 | A1 * | 2/2004 | Wu | F04D 29/34 | 416/206 |
| 2004/0042903 | A1 | 3/2004 | Huang | | |
| 2018/0128276 | A1 * | 5/2018 | Li | F04D 25/06 | |
| 2018/0347573 | A1 * | 12/2018 | Horng | F04D 25/088 | |
| 2019/0072098 | A1 * | 3/2019 | Horng | F04D 29/34 | |
| 2019/0072107 | A1 * | 3/2019 | Horng | F04D 29/388 | |

FOREIGN PATENT DOCUMENTS

| | | | |
|---|---|---|---|
| JP | 2002161893 | A | 6/2002 |
| TW | 403378 | | 8/2000 |
| TW | M329113 | U | 3/2008 |
| TW | I601920 | B | 10/2017 |
| WO | 2018042381 | A1 | 3/2018 |

* cited by examiner

BLADE ADAPTER AND CEILING FAN INCLUDING THE SAME

CROSS REFERENCE TO RELATED APPLICATION

The application claims the benefit of Taiwan application serial No. 107121560, filed on Jun. 22, 2018, and the entire contents of which are incorporated herein by reference.

BACKGROUND OF THE INVENTION

1. Field of the Invention

The present invention generally relates to a blade adapter and a ceiling fan including the same and, more particularly, to a blade adapter that can adjust the air volume and the airflow range as well as a ceiling fan including the same.

2. Description of the Related Art

Ceiling fans have been widely used since they do not occupy the floor space and provide an excellent air-flowing effect. A conventional ceiling fan includes a stator, a rotor and a plurality of blades. The stator includes an axle with which the rotor is rotatably coupled. The rotor includes a hub with which the blades are coupled. The hub and the blades jointly rotate relatively to the axle. As such, the blades are able to cause the air to flow. An example of such a ceiling fan is seen in Taiwan Patent No. 1601920.

After the blades are coupled with the hub, the windward angle or the airflow range of the blades is constant. Since different customers demand different types of the ceiling fans such as the one with a smaller air volume, a larger air volume, a smaller airflow range or a larger airflow range, manufacturers need to utilize molding in order to produce different types of blades with different angles. This is time-consuming and significantly increases the manufacturing cost, making it uneconomical to produce ceiling fans.

In light of this, it is necessary to improve the conventional ceiling fan.

It is therefore the objective of this invention to provide a blade adapter and a ceiling fan including the same, in which the blade connection sections of the blade adaptor are coupled with a plurality of blades of the ceiling fan. In this arrangement, a windward adjustment angle or an inclination adjustment angle is presented between each of the plurality of blades and a horizontal plane, thus meeting the needs of different customers.

In an aspect, a blade adapter including a support portion and a plurality of blade connection sections is disclosed. The plurality of blade connection sections is connected to an outer periphery of the support portion. Each of the plurality of blade connection sections has a first face and a blade connection face opposite to the first face. The blade connection face includes at least one inclined portion. A windward adjustment angle or an inclination adjustment angle is presented between the at least one inclined portion and a horizontal plane.

In another aspect, a ceiling fan including a motor, the blade adapter as mentioned above, and a plurality of blades is disclosed. The support portion of the blade adapter is coupled with the motor. The plurality of blades is coupled with the blade connection faces of the plurality of blade connection sections, respectively.

Based on this, with the blade adaptor and the ceiling fan including the same according to the invention, the blade connection face of the blade connection section includes at least one inclined portion. After the blade is connected to the blade connection face, the blade can form the windward adjustment angle to adjust the volume of the airflow or can be disposed in an upwardly or downwardly inclined manner to adjust the range of the airflow. In this arrangement, no matter what kinds of the ceiling fans (i.e. the one with a smaller air volume, a larger air volume, a smaller airflow range or a larger airflow range) are in demand, the manufacturers do not need to proceed with molding for other types of the blades. Thus, the manufacturing cost is effectively reduced and the production of the ceiling fans is of high economic benefit.

In an example, the blade connection face has a first windward long side and a first air-guiding long side opposite to the first windward long side, and a distance between the first face and the blade connection face gradually increases from the first windward long side to the first air-guiding long side to form the at least one inclined portion. The windward adjustment angle is presented between the at least one inclined portion and the horizontal plane. In this arrangement, the structure is simple and the manufacturing is convenient, thereby reducing the manufacturing cost.

In the example, the blade connection face has an outer short side relatively distant to the support portion, and a distance between the first face and the blade connection face of each of the plurality of blade connection sections gradually increases from the outer short side of the blade connection section to an interconnected part of the blade connection section and the support portion to form the at least one inclined portion. The inclination adjustment angle is presented between the at least one inclined portion and the horizontal plane. In this arrangement, the structure is simple and the manufacturing is convenient, thereby reducing the manufacturing cost.

In another example, the blade connection face has an outer short side relatively distant to the support portion, and a distance between the first face and the blade connection face of each of the plurality of blade connection sections gradually reduces from the outer short side to an interconnected part of the blade connection section and the support portion to form the at least one inclined portion. The inclination adjustment angle is presented between the at least one inclined portion and the horizontal plane. In this arrangement, the structure is simple and the manufacturing is convenient, thereby reducing the manufacturing cost.

In the example, the at least one inclined portion includes two inclined portions. The first face has a second windward long side and a second air-guiding long side opposite to the second windward long side. A bendable portion is provided on the first face at a location relatively adjacent to the support portion and is connected between the second windward long side and the second air-guiding long side. Each of the plurality of blade connection sections bends relatively to the support portion along the bendable portion to form the two inclined portions. The windward adjustment angle and the inclination adjustment angle are presented between the two inclined portions and the horizontal plane. In this arrangement, the structure is simple and the manufacturing is convenient, thereby reducing the manufacturing cost.

In the example, the first face has a second windward long side and a second air-guiding long side opposite to the second windward long side. A bendable portion is provided on the first face at a location relatively adjacent to the support portion and is connected between and perpendicular to the second windward long side and the second air-guiding long side. Each of the plurality of blade connection sections bends relatively to the support portion along the bendable portion to form the at least one inclined portion. The inclination adjustment angle is presented between the at least one inclined portion and the horizontal plane. In this arrangement, the structure is simple and the manufacturing is convenient, thereby reducing the manufacturing cost.

In the example, another bendable portion is provided on the blade connection face and is aligned with the bendable portion of the first face. In this arrangement, the blade connection section can easily bend relatively to the support portion.

In the example, the bendable portion is in a form of a groove, a fold line or a crease. In this arrangement, the blade connection section can smoothly bend relatively to the support portion, improving the smoothness in the bending operation.

In the example, the windward adjustment angle is larger than or equal to 2 degrees and is smaller than or equal to 15 degrees. Therefore, the volume of the air as guided is increased.

In the example, the inclination adjustment angle is larger than or equal to 2 degrees and is smaller than or equal to 15 degrees. Therefore, better airflow range is provided.

In the example, the support portion is in a form of a plurality of circumferential sections interconnected to each other. Therefore, the plurality of circumferential sections of the support portion can be stacked with each other during the delivery, improving the convenience in delivery.

In the example, each of the plurality of blades connection sections is integrally formed with a corresponding one of the plurality of circumferential sections, and the plurality of blade connection sections and the plurality of circumferential sections are made of metal. Therefore, the structural strength of the blade adapter is improved.

In the example, the blade adapter further includes a plurality of stopper protrusions adjoining the support portion and respectively protruding beyond the blade connection faces of the plurality of blade connection sections. Therefore, the plurality of blades can be more easily positioned.

In the example, each of the plurality of blade connection sections has at least one screwing hole, each of the plurality of blades has at least one through-hole corresponding to the at least one screwing hole, and at least one fastener extends through the at least one screwing hole and the at least one through-hole. Therefore, reliable engagement is attained.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
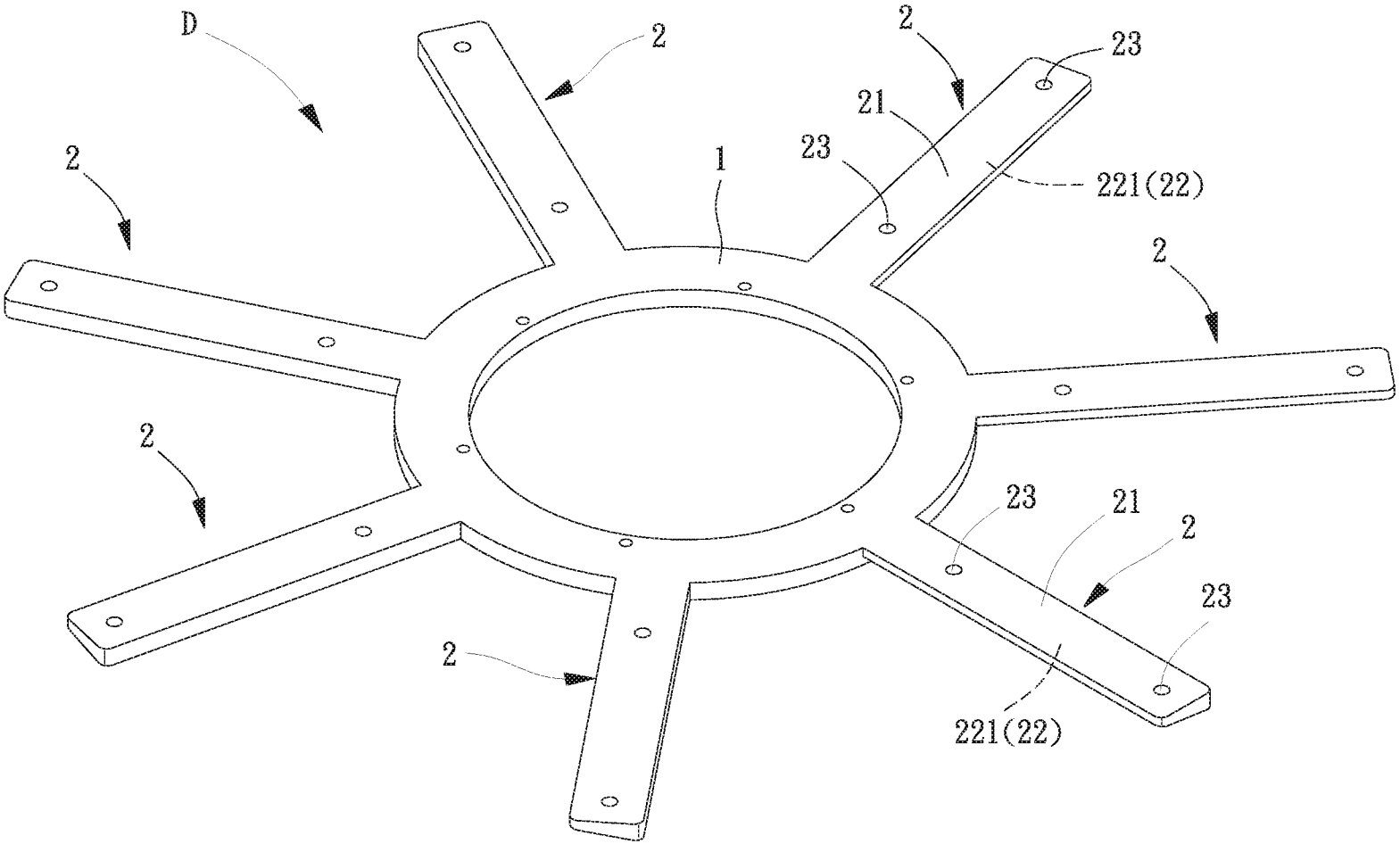
FIG. 1 is a perspective view of a blade adapter according to a first embodiment of the invention.

In the various figures of the drawings, the same numerals designate the same or similar parts. Furthermore, when the terms "first", "second", "third", "fourth", "inner", "outer", "top", "bottom", "front", "rear", "axial", "radial", "longitudinal", "transverse", "length", "width", "height" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

FIG. 1 shows a blade adaptor D according to a first embodiment of the invention. The blade adaptor D includes a support portion 1 and a plurality of blade connection sections 2 connected to an outer periphery of the support portion 1.

Figure 2:
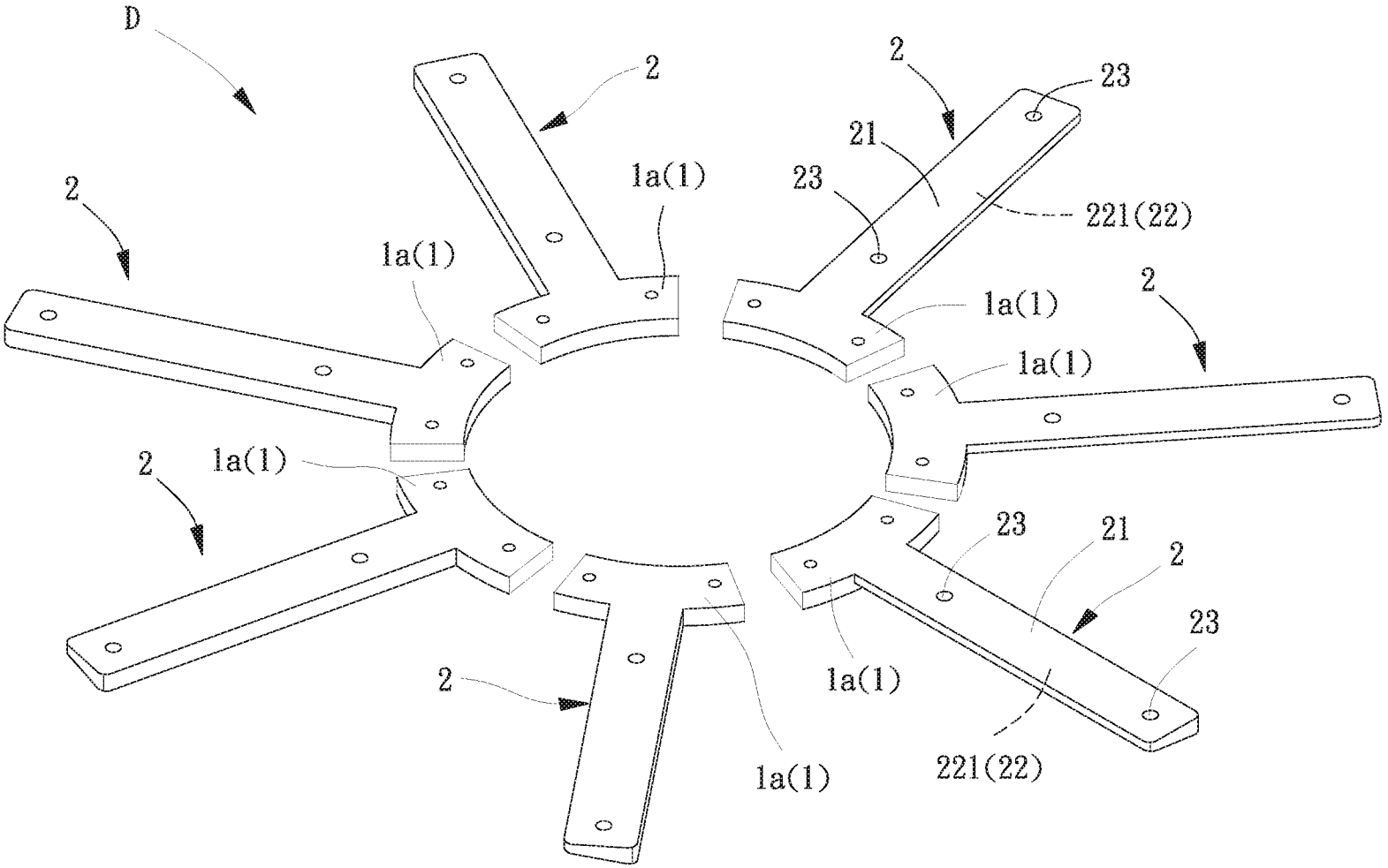
FIG. 2 is an exploded, perspective view of another implementation of the blade adapter of the first embodiment of the invention.

The blade adaptor D is preferably in a circular form. The blade adaptor D may be formed in an integral manner, or may consist of a plurality of interconnected circumferential sections 1*a* as shown in FIG. 2. The circumferential sections 1*a* of the support portion 1 can be stacked with each other during the package and the delivery, improving the convenience in delivery.

The blade connection sections 2 can be connected to the support portion 1. Preferably, the blade connection sections 2 and the support portion 1 are made of metal and are integrally formed with each other to enhance the structural strength of the blade adaptor D. Each of the blade connection sections 2 includes a first face 21 and a blade connection face 22. The first face 21 is located on the top side of the blade connection section 2 and the blade connection face 22 is located on the bottom side of the blade connection section 2. Alternatively, the first face 21 is located on the bottom side of the blade connection section 2 and the blade connection face 22 is located on the top side of the blade connection section 2. The invention is not limited to either option. In this embodiment, the first face 21 is located on the top side of the blade connection section 2 and the blade connection face 22 is located on the bottom side of the blade connection section 2.

Figure 3:
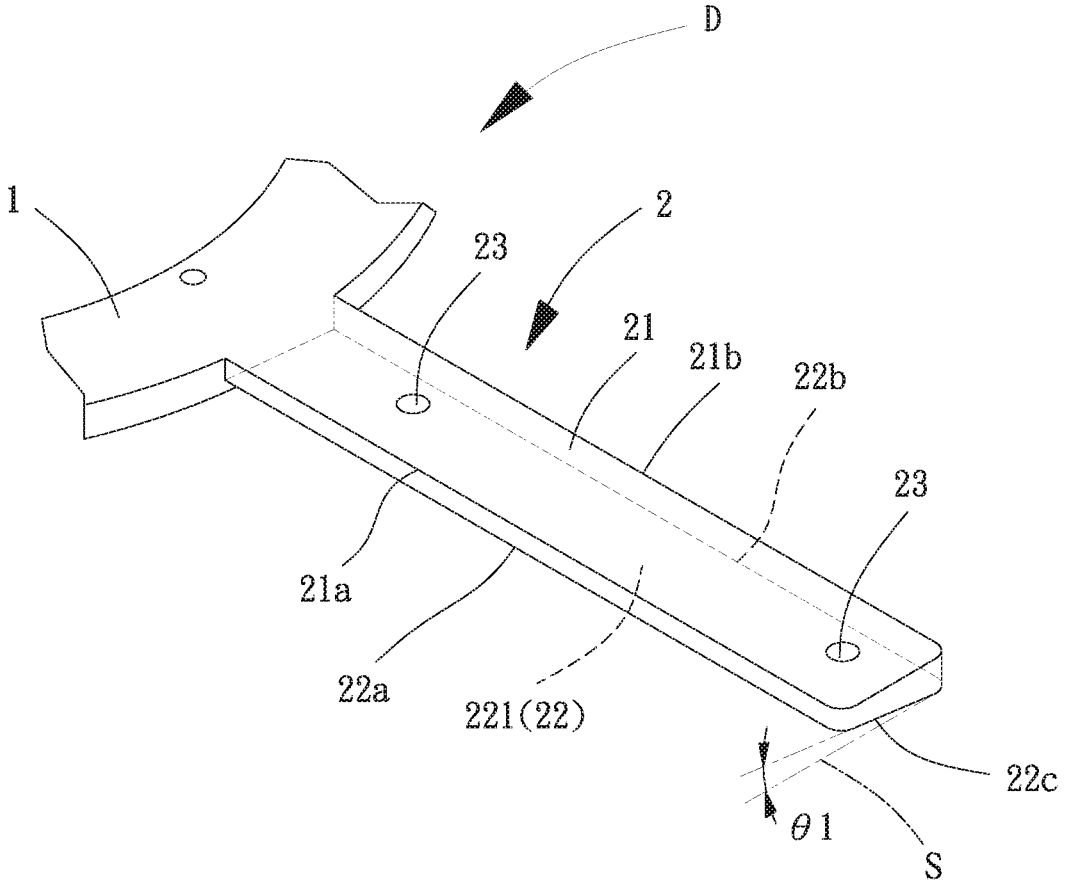
FIG. 3 is a partially enlarged view of the blade adapter of FIG. 1.

Specifically, referring to FIG. 3, the blade connection face 22 includes a first windward long side 22*a* and a first air-guiding long side 22*b*. The distance between the first face 21 and the blade connection face 22 (i.e. the thickness of the blade connection section 2) gradually increases from the first windward long side 22*a* to the first air-guiding long side 22*b*. Thus, a first inclined portion 221 is formed on the blade connection face 22. A windward adjustment angle θ1 is presented between the first inclined portion 221 and a horizontal plane S. The windward adjustment angle θ1 is preferably larger than or equal to 2 degrees and is smaller than or equal to 15 degrees. Each blade connection section 2 may have a plurality of screwing holes 23 extending through the blade connection section 2 from the first face 21 to the blade connection face 22.

Figure 4:
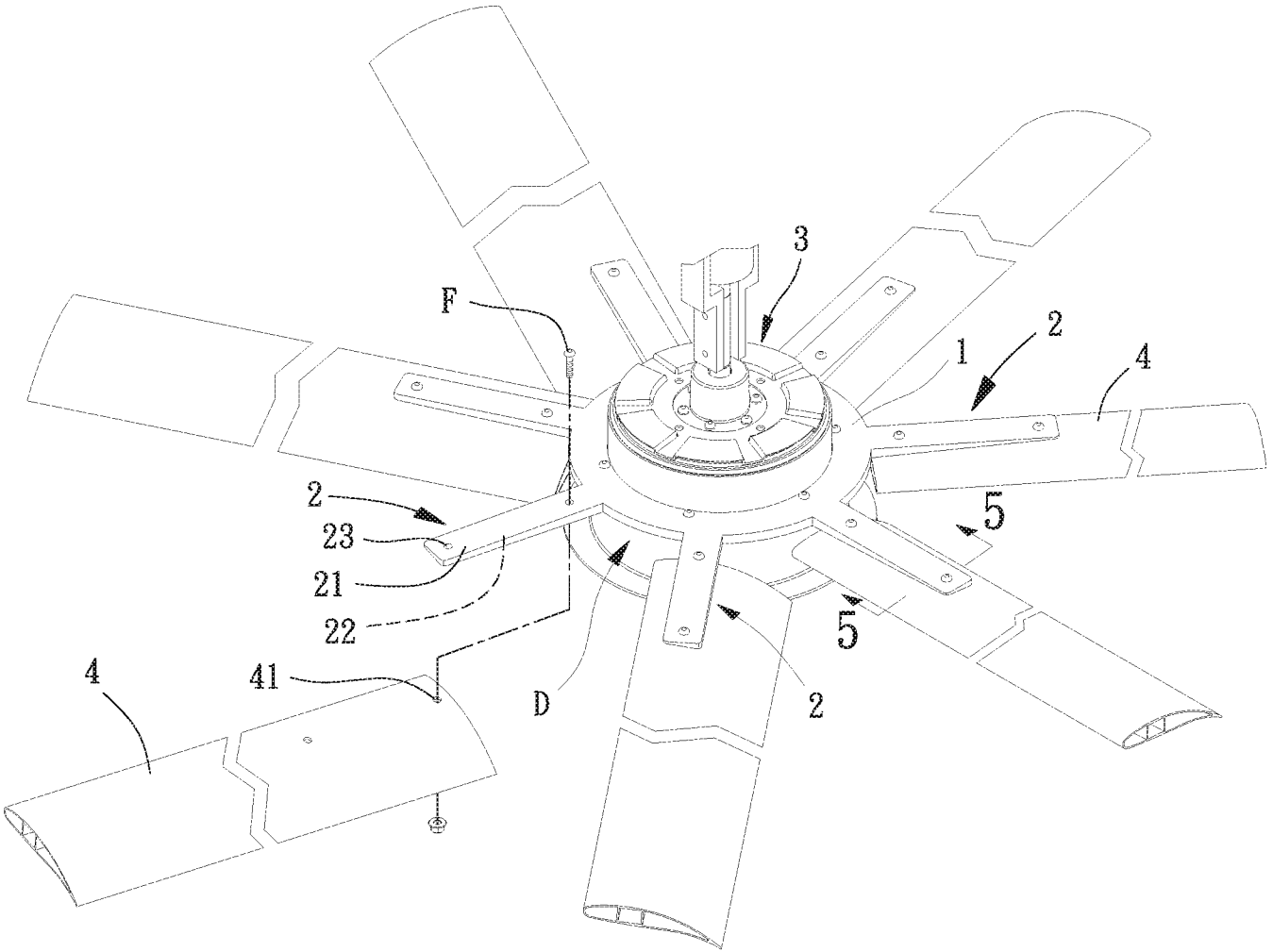
FIG. 4 shows a ceiling fan including the blade adapter of FIG. 1.
Figure 5:
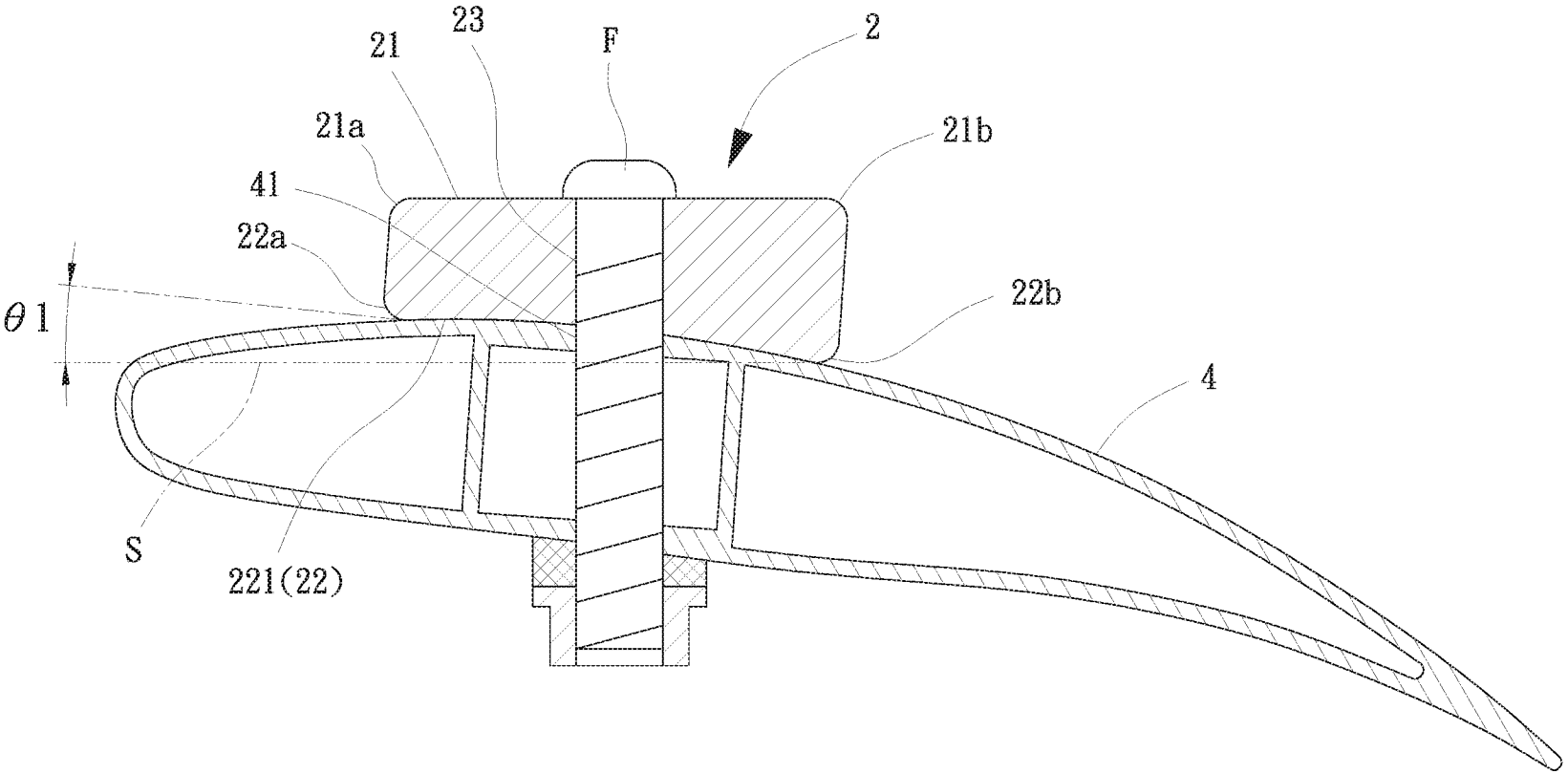
FIG. 5 is a partially enlarged, cross sectional view of the ceiling fan of FIG. 4 taken along line 5-5.

Referring to FIGS. 4 and 5, based on above structure, the blade adaptor D is used in a ceiling fan including a motor 3 and a plurality of blades 4. The blade adaptor D is coupled with the motor 3 via the support portion 1. Each of the plurality of blades 4 is connected to the blade connection face 22 of a respective one of the plurality of blade connection sections 2. Each of the plurality of blades 4 has a plurality of through-holes 41 corresponding to the plurality of screwing holes 23 of the blade connection section 2, respectively. Based on this, a fastener F extends through a pair of the screwing hole 23 and the through-hole 41, securely connecting the blade 4 to the blade connection face 22 of the blade connection section 2. Thus, the engagement between the blade connection section 2 and the blade 4 is reinforced.

Based on this, the first inclined portion 221 of the blade connection face 22 forms the windward adjustment angle θ1 of the blade 4 relative to the horizontal plane S. During the rotation of the ceiling fan, air is split by the blade 4 at the windward side of the blade 4, forming an upper stream of the airflow and a lower stream of the airflow. The arrangement of the windward adjustment angle θ1 increases the volume of the lower stream of the airflow, thereby increasing the volume of the air driven. In this regard, although the motor 3 operates in a low speed, the plurality of blades 4 can effectively drive the air to flow, thereby maintaining a predetermined volume of the air driven while attaining an energy-saving effect.

Figure 6:
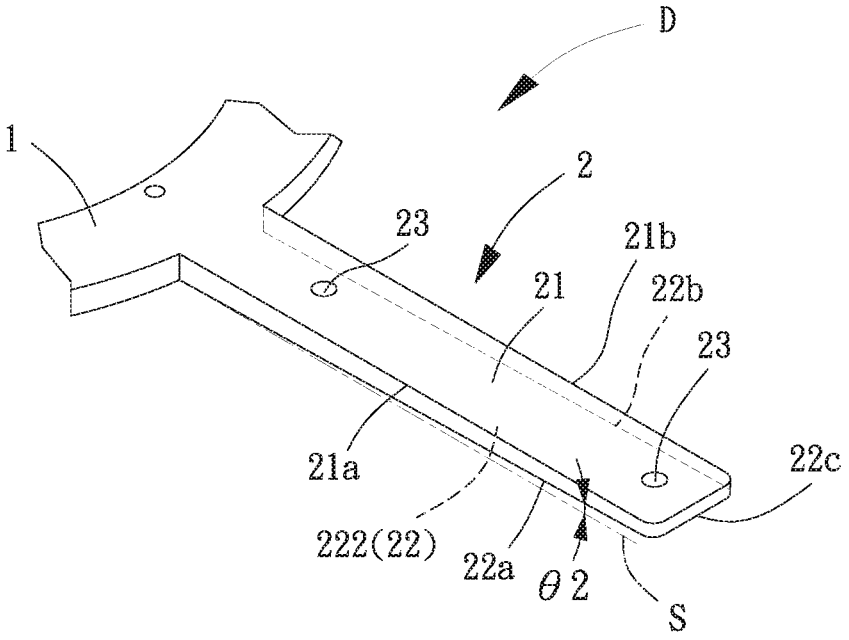
FIG. 6 is a partially enlarged, perspective view of a blade adapter according to a second embodiment of the invention.

FIG. 6 is a partial view of the blade adaptor D according to a second embodiment of the invention. In this embodiment, the blade connection face 22 has an inner short side 22*d* and an outer short side 22*c* relatively distant to the support portion 1 compared to the inner short side 22*d*. The distance between the first face 21 and the blade connection face 22 (i.e. the thickness of the blade connection section 2) gradually increases from the outer short side 22*c* to an interconnected part of the blade connection section 2 and the support portion 1, forming a second inclined portion 222. An inclination adjustment angle θ2 is presented between the second inclined portion 222 and a horizontal plane S. The inclination adjustment angle θ2 is preferably larger than or equal to 2 degrees and is smaller than or equal to 15 degrees, enabling the inclination adjustment of the blade 4.

Figure 7:
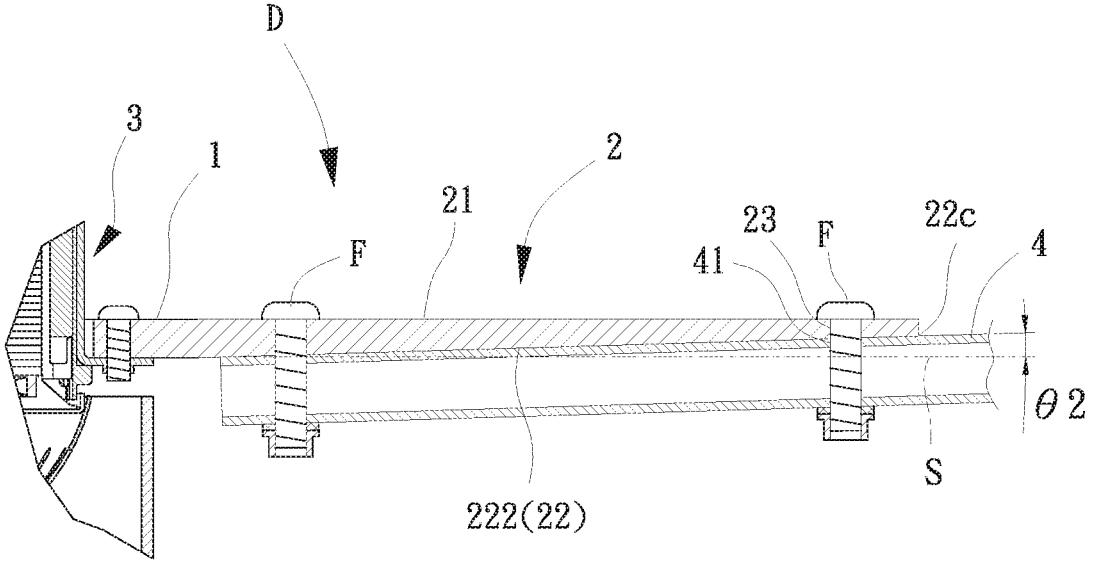
FIG. 7 is a partially enlarged, cross sectional view of the blade adapter of FIG. 6 that is coupled with a blade.
Figure 8:
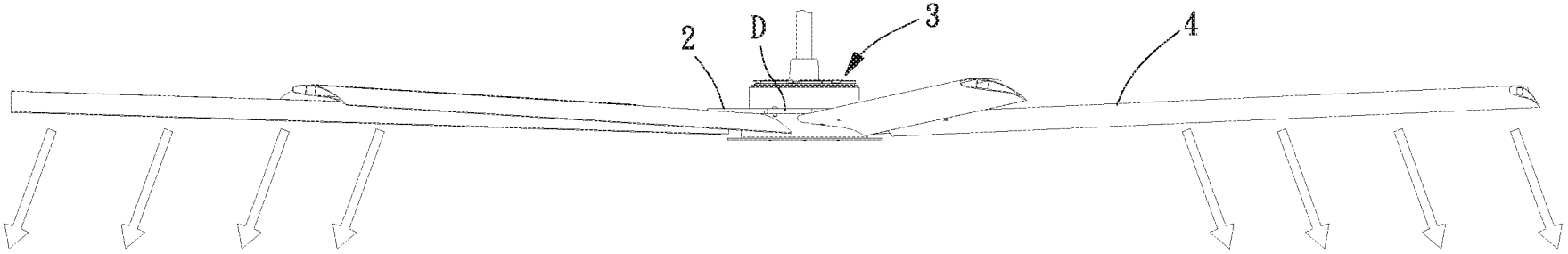
FIG. 8 is a perspective view of a ceiling fan after assembly.

Referring to FIGS. 7 and 8, after the blade 4 is connected to the blade connection face 22 of the blade connection section 2, the blade 4 is upwardly inclined at the outer short side 22*c* under the arrangement of the second inclined portion 222 of the blade connection face 22. When the ceiling fan rotates, the upwardly inclined blade 4 can enlarge the airflow range to provide a larger airflow space. As a result, the air circulation is enhanced and a comfortable environment is provided.

Figure 9:
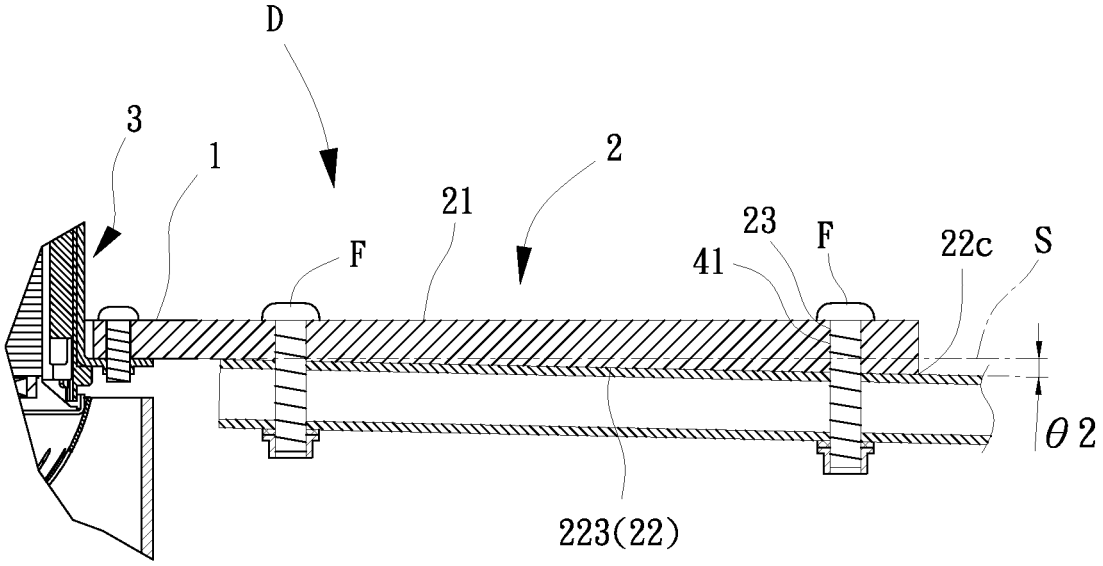
FIG. 9 is a partially enlarged, cross sectional view of a ceiling fan including a blade adaptor according to a third embodiment of the invention.

FIG. 9 is a partial, cross sectional view of the blade adaptor D according to a third embodiment of the invention. In this embodiment, the distance between the first face 21 and the blade connection face 22 (i.e. the thickness of the blade connection section 2) gradually reduces from the outer short side 22*c* to the interconnected part of the blade connection section 2 and the support portion 1, forming a third inclined portion 223. An inclination adjustment angle θ2 is presented between the third inclined portion 223 and a horizontal plane S. After the blade 4 is connected to the blade connection face 22 of the blade connection section 2, the blade 4 is downwardly inclined at the outer short side 22*c* under the arrangement of the third inclined portion 223 of the blade connection face 22. When the ceiling fan rotates, the downwardly inclined blade 4 can reduce the airflow range to provide a smaller airflow space with concentrated airflows.

Figure 10:
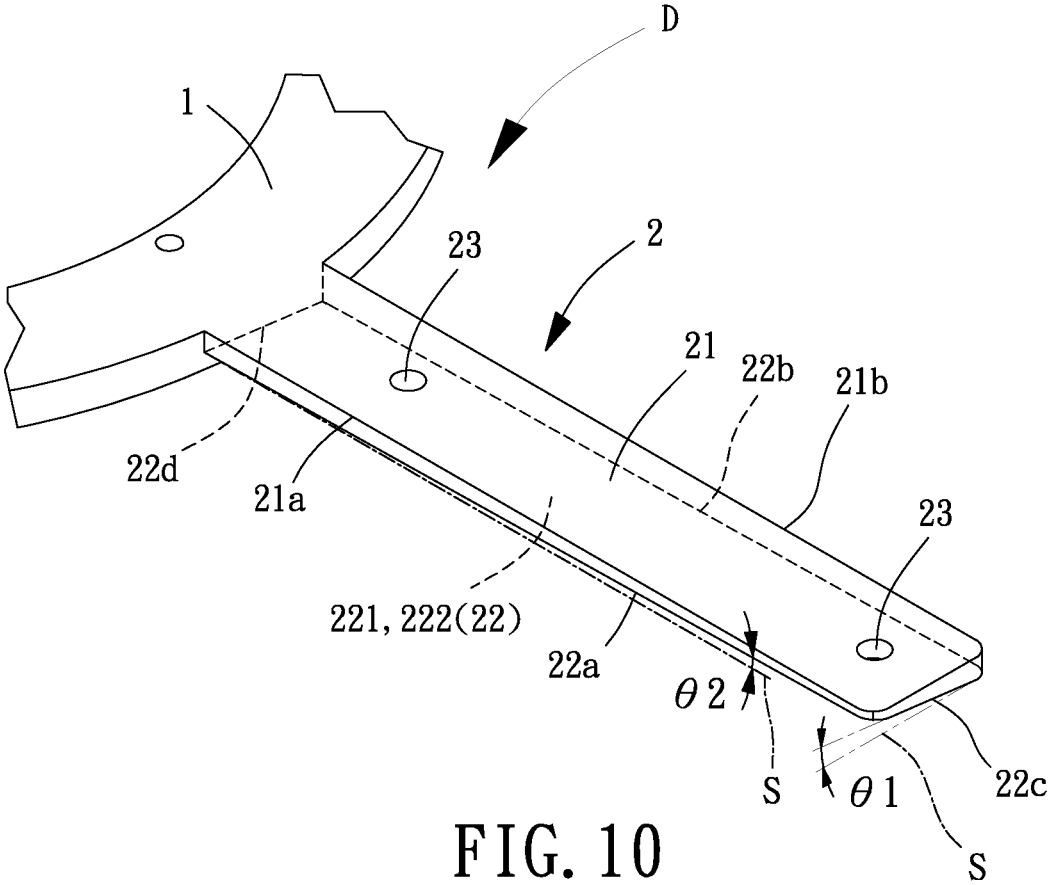
FIG. 10 is a partially enlarged view of a blade adaptor according to a fourth embodiment of the invention.

FIG. 10 is a partial view of the blade adaptor D according to a fourth embodiment of the invention. In this embodiment, the distance between the first face 21 and the blade connection face 22 (i.e. the thickness of the blade connection section 2) gradually increases from the first windward long side 22*a* to the first air-guiding long side 22*b* and gradually increases from the outer short side 22*c* to the interconnected part of the blade connection section 2 and the support portion 1, forming the second inclined portion 222. In this regard, the blade connection face 22 includes both the first inclined portion 221 and the second inclined portion 222. A windward adjustment angle θ1 is presented between the first inclined portion 221 and a horizontal plane S, and an inclination adjustment angle θ2 is presented between the second inclined portion 222 and the horizontal plane S.

Based on the above, after the blade 4 (as shown in FIG. 4) is connected to the blade connection face 22 of the blade connection section 2, the windward adjustment angle θ1 is presented between the blade 4 and the horizontal plane S under the arrangement of the first inclined portion 221. In this regard, the blade 4 is upwardly inclined at the outer short side 22*c* under the arrangement of the second inclined portion 222 of the blade connection face 22. When the ceiling fan rotates, the volume of the air driven by the ceiling fan is increased and the airflow range of the ceiling fan is enlarged, thus improving the convenience in use.

Figure 11:
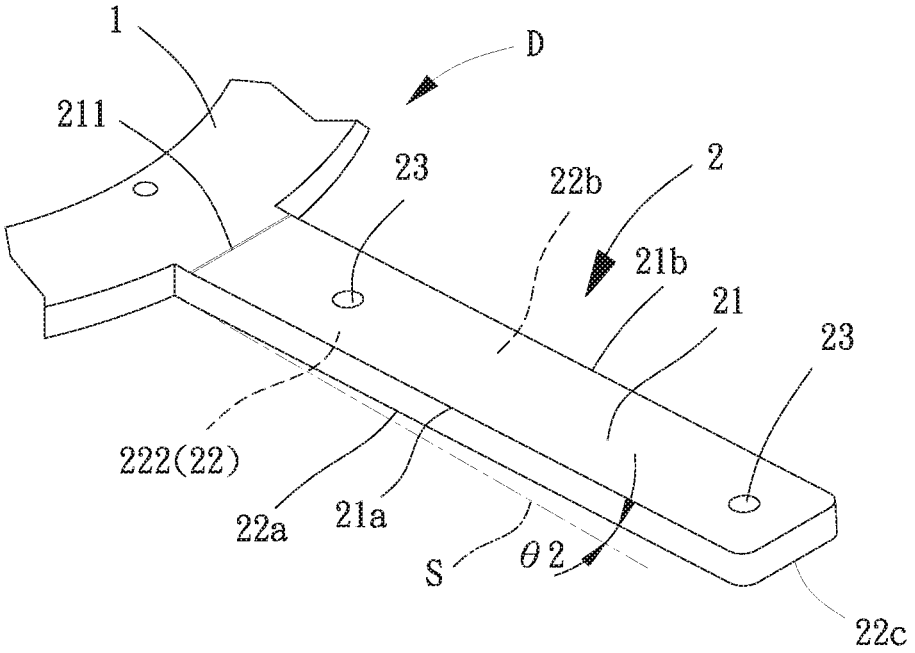
FIG. 11 is a partially enlarged view of a blade adaptor according to a fifth embodiment of the invention.

FIG. 11 is a partial view of the blade adaptor D according to a fifth embodiment of the invention. In this embodiment, the first face 21 includes a second windward long side 21*a* and a second air-guiding long side 21*b*. A bendable portion 211 is arranged on the first face 21 at a location adjacent to the support portion 1. The bendable portion 211 is configured for the blade connection section 2 to bend relatively to the support portion 1. In a preferred case, the bendable portion 211 is connected between and perpendicular to the second windward long side 21*a* and the second air-guiding long side 21*b*. The bendable portion 211 is in the form of a fold line or a crease. In this embodiment, the bendable portion 211 is a shallow groove which provides a convenient bending mechanism for the blade connection section 2. Based on this, the blade connection section 2 can be bent upwards or downwards along the bendable portion 211. In this embodiment, the blade connection section 2 is bent upwards for discussion purpose. In this example, the blade connection face 22 forms the second inclined portion 222 where the inclination adjustment angle θ2 is presented between the second inclined portion 222 and the horizontal plane S. This is another way of forming the inclination adjustment angle θ2.

Figure 12:
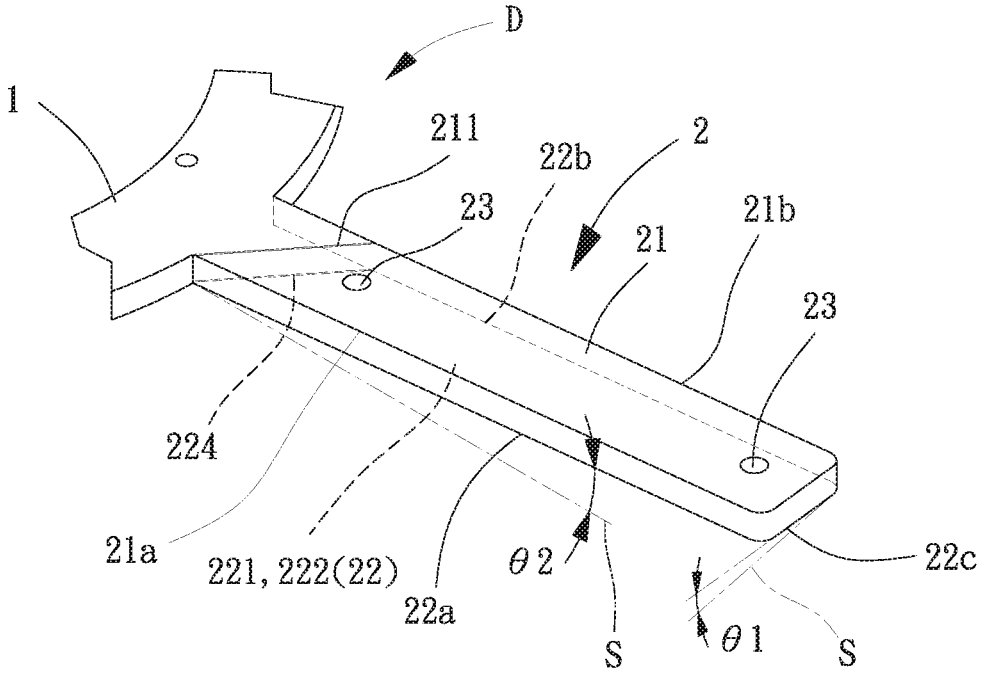
FIG. 12 is a partially enlarged view of a blade adaptor according to a sixth embodiment of the invention.

FIG. 12 is a partial view of the blade adaptor D according to a sixth embodiment of the invention. In this embodiment, the bendable portion 211 is connected between the second windward long side 21*a* and the second air-guiding long side 21*b* and the bendable portion 211 is not perpendicular to the second windward long side 21*a* and the second air-guiding long side 21*b*. Based on this, when the blade connection section 2 bends relatively to the support portion 1 along the bendable portion 211, the blade connection face 22 forms the first inclined portion 221 and the second inclined portion 222. The windward adjustment angle θ1 is formed between the horizontal plane S and the first inclined portion 221. The inclination adjustment angle θ2 is formed between the second inclined portion 222 and the horizontal plane S. This is another way of forming the windward adjustment angle θ1 and the inclination adjustment angle θ2.

Besides, the blade connection face 22 in this embodiment includes another bendable portion 224. The bendable portion 224 of the blade connection face 22 is preferably aligned with the bendable portion 211 of the first face 21. When the blade connection section 2 bends relatively to the support portion 1, the bendable portions 211 and 224 permit the blade connection section 2 to be bent relatively to the support portion 1 more easily. Advantageously, the production time is reduced.

Figure 13:
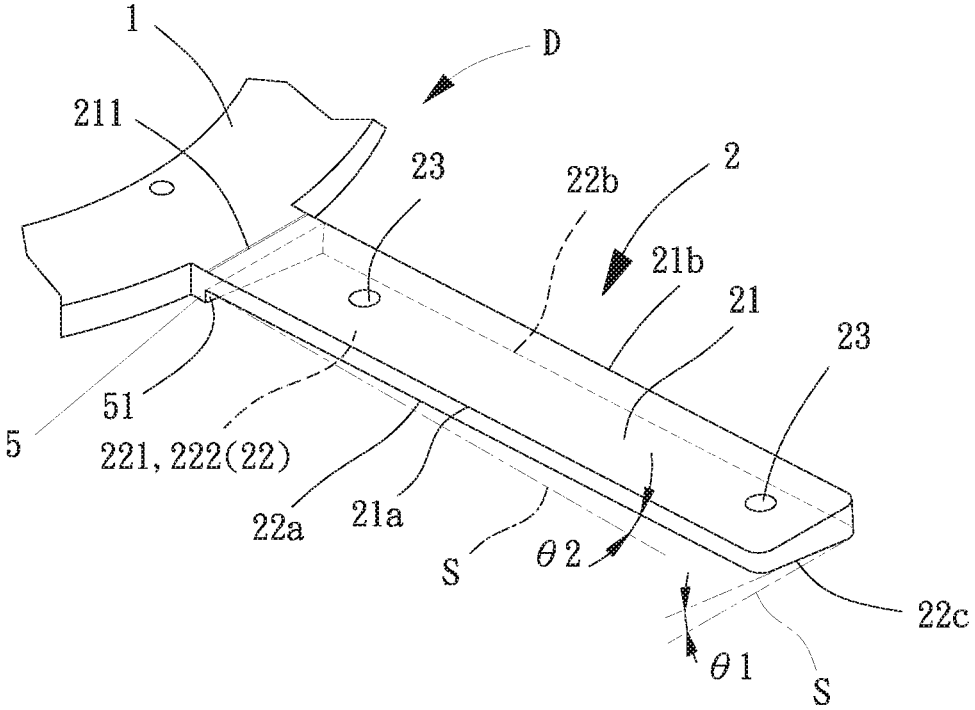
FIG. 13 is a partially enlarged view of a blade adaptor according to a seventh embodiment of the invention.

FIG. 13 is a partial view of the blade adaptor D according to a seventh embodiment of the invention. In this embodiment, the distance between the first face 21 and the blade connection face 22 (i.e. the thickness of the blade connection section 2) gradually increases from the first windward long side 22*a* to the first air-guiding long side 22*b*, forming the first inclined portion 221 on the blade connection face 22. The windward adjustment angle θ1 is presented between the first inclined portion 221 and a horizontal plane S. Besides, the bendable portion 211 is connected between and perpendicular to the second windward long side 21*a* and the second air-guiding long side 21*b*. Based on this, the blade connection section 2 can be bent upwards relatively to the support portion 1 and along the bendable portion 211. In this regard, the blade connection face 22 forms the second inclined portion 222 where the inclination adjustment angle θ2 is presented between the second inclined portion 222 and the horizontal plane S. This is another way of forming the windward adjustment angle θ1 and the inclination adjustment angle θ2.

Besides, the blade adaptor D may further include a stopper protrusion 5 adjoining the support portion 1 and protruding beyond the blade connection face 22. The stopper protrusion 5 is preferably integrally formed with the blade connection section 2 to increase the structural strength of the blade adaptor D. The stopper protrusion 5 has an inner face 51 adjoining the blade connection face 22. An end face of the blade 4 (as shown in FIG. 4) which is adjacent to the motor 3 (as shown in FIG. 4) preferably abuts the inner face 51 of the stopper protrusion 5. In this arrangement, the blade 4 can be positioned more easily during the assembly of the blade 4, improving the convenience in assembly.

Based on the above, with the blade adaptor and the ceiling fan including the same according to the invention, the blade connection face of the blade connection section includes at least one inclined portion. After the blade is connected to the blade connection face, the blade can form the windward adjustment angle to adjust the volume of the airflow or can be disposed in an upwardly or downwardly inclined manner to adjust the range of the airflow. In this arrangement, no matter what kinds of the ceiling fans (i.e. the one with a smaller air volume, a larger air volume, a smaller airflow range or a larger airflow range) are in demand, the manufacturers do not need to proceed for molding for other types of the blades. Thus, the manufacturing cost is effectively reduced and the production of the ceiling fans is of high economic benefit.

Although the invention has been described in detail with reference to its presently preferable embodiments, it will be understood by one of ordinary skill in the art that various modifications can be made without departing from the spirit and the scope of the invention, as set forth in the appended claims

What is claimed is:

1. A blade adapter comprising:

a support portion;

a plurality of blade connection sections connected to an outer periphery of the support portion, wherein each of the plurality of blade connection sections has a first face and a blade connection face opposite to the first face, wherein the blade connection face includes two inclined portions, wherein the first face has a second windward long side and a second air-guiding long side opposite to the second windward long side, wherein a bendable portion is provided on the first face at a location relatively adjacent to the support portion and is connected between the second windward long side and the second air-guiding long side, wherein each of the plurality of blade connection sections bends relatively to the support portion along the bendable portion to form the two inclined portions, and wherein a windward adjustment angle and an inclination adjustment angle are presented between the two inclined portions and a horizontal plane.

2. The blade adapter as claimed in claim 1, wherein the blade connection face has a first windward long side and a first air-guiding long side opposite to the first windward long side, wherein a distance between the first face and the blade connection face gradually increases from the first windward long side to the first air-guiding long side to form the two inclined portions, and wherein the windward adjustment angle is presented between the two inclined portions and the horizontal plane.

3. The blade adapter as claimed in claim 1, wherein the blade connection face has an outer short side relatively distant to the support portion, wherein a distance between the first face and the blade connection face of each of the plurality of blade connection sections gradually increases from the outer short side of the blade connection section to an interconnected part of the blade connection section and the support portion to form the two inclined portions, and wherein the inclination adjustment angle is presented between the two inclined portions and the horizontal plane.

4. The blade adapter as claimed in claim 1, wherein the blade connection face has an outer short side relatively distant to the support portion, wherein a distance between the first face and the blade connection face of each of the plurality of blade connection sections gradually reduces from the outer short side to an interconnected part of the blade connection section and the support portion to form the two inclined portions, and wherein the inclination adjustment angle is presented between the two inclined portions and the horizontal plane.

5. The blade adapter as claimed in claim 1, wherein the bendable portion is perpendicular to the second windward long side and the second air-guiding long side.

6. The blade adapter as claimed in claim 5, wherein another bendable portion is provided on the blade connection face and is aligned with the bendable portion of the first face.

7. The blade adapter as claimed in claim 1, wherein the bendable portion is in a form of a groove, a fold line or a crease.

8. The blade adapter as claimed in claim 1, wherein the blade connection face includes a first windward long side and a first air-guiding long side opposite to the first windward long side, wherein the first windward long side is axially higher than the first air-guiding long side to form the windward adjustment angle, and wherein the windward adjustment angle is larger than or equal to 2 degrees and is smaller than or equal to 15 degrees.

9. The blade adapter as claimed in claim 1, wherein the blade connection face includes an inner short side and an outer short side relatively distant to the support portion compared to the inner short side, wherein the outer short side is axially higher or lower than the inner short side to form the inclination adjustment angle, and wherein the inclination adjustment angle is larger than or equal to 2 degrees and is smaller than or equal to 15 degrees.

10. The blade adapter as claimed in claim 1, wherein the support portion comprises a plurality of circumferential sections interconnected to each other.

11. The blade adapter as claimed in claim 10, wherein each of the plurality of blade connection sections is integrally formed with a corresponding one of the plurality of circumferential sections of the support portion, and wherein the plurality of blade connection sections and the plurality of circumferential sections are made of metal.

12. The blade adapter as claimed in claim 1, further comprising a plurality of stopper protrusions adjoining the support portion and respectively protruding beyond the blade connection faces of the plurality of blade connection sections.

13. A ceiling fan comprising:

a motor;

the blade adapter as claimed in claim 1, wherein the support portion is coupled with the motor; and a plurality of blades coupled with the blade connection faces of the plurality of blade connection sections, respectively.

14. The ceiling fan as claimed in claim 13, wherein each of the plurality of blade connection sections has at least one screwing hole, wherein each of the plurality of blades has at least one through-hole corresponding to the at least one screwing hole, and wherein at least one fastener extends through the at least one screwing hole and the at least one through-hole.

* * * * *